US006722753B2

(12) United States Patent
Helterline et al.

(10) Patent No.: US 6,722,753 B2
(45) **Date of Patent: *Apr. 20, 2004**

(54) METHOD AND APPARATUS FOR CHECKING COMPATIBILITY OF A REPLACEABLE PRINTING COMPONENT

(75) Inventors: Brian L. Helterline, Salem, OR (US); Winthrop D. Childers, San Diego, CA (US); Michael L. Bullock, San Diego, CA (US); Ronald R. Paulsen, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/271,422

(22) Filed: Oct. 15, 2002

(65) Prior Publication Data

US 2003/0035017 A1 Feb. 20, 2003

Related U.S. Application Data

(63) Continuation of application No. 09/146,746, filed on Sep. 3, 1998.

(51) Int. Cl.[7] ..... B41J 29/393
(52) U.S. Cl. ..... 347/19
(58) Field of Search ..... 347/19, 49, 86, 347/23, 711, 103

(56) References Cited

U.S. PATENT DOCUMENTS

| | | | | |
|---|---|---|---|---|
| 4,551,000 A | | 11/1985 | Kanemitsu et al. | 355/3 R |
| 4,803,521 A | | 2/1989 | Honda | 355/14 R |
| 4,961,088 A | | 10/1990 | Gilliland et al. | 355/206 |
| 5,021,828 A | | 6/1991 | Yamaguchi et al. | 355/209 |
| 5,049,898 A | | 9/1991 | Arthur et al. | 346/1.1 |
| 5,113,344 A | | 5/1992 | Kellogg et al. | 364/424.04 |
| 5,137,379 A | | 8/1992 | Ukai et al. | 400/121 |
| 5,138,344 A | | 8/1992 | Ujita | 346/140 R |
| 5,184,181 A | | 2/1993 | Kurando et al. | 355/260 |
| 5,272,503 A | | 12/1993 | LeSueur et al. | 355/208 |
| 5,278,584 A | * | 1/1994 | Keefe et al. | 347/63 |
| 5,278,962 A | | 1/1994 | Masuda et al. | 711/207 |
| 5,410,641 A | | 4/1995 | Wakabayashi et al. | 395/112 |
| 5,519,422 A | | 5/1996 | Thoman et al. | 347/49 |
| 5,610,635 A | | 3/1997 | Murray et al. | 347/19 |
| 5,627,572 A | | 5/1997 | Harrington, II et al. | 347/23 |
| 5,646,660 A | | 7/1997 | Murray | 347/59 |
| 5,699,091 A | | 12/1997 | Bullock et al. | 347/19 |
| 5,835,817 A | | 11/1998 | Bullock et al. | 347/19 |
| 5,946,714 A | | 8/1999 | Miyauchi | 711/103 |
| 6,039,430 A | | 3/2000 | Helterline et al. | 347/19 |
| 6,065,824 A | | 5/2000 | Bullock et al. | 347/19 |
| 6,264,301 B1 | | 7/2001 | Helterline et al. | 347/19 |
| 6,488,352 B1 | * | 12/2002 | Helterline et al. | 347/19 |

FOREIGN PATENT DOCUMENTS

| | | | | |
|---|---|---|---|---|
| JP | 05-193127 | | 3/1993 | 347/19 |
| JP | 05193127 | * | 8/1993 | 347/19 |

* cited by examiner

*Primary Examiner*—Thinh Nguyen
*Assistant Examiner*—Julian D. Huffman

(57) ABSTRACT

The present disclosure relates to an ink jet printing system configured for receiving replaceable printing component. The ink jet printing system includes a replaceable printing component having an electrical storage device associated therewith. The electrical storage device has a data field therein specifying data organization within the electrical storage device. Also included is a printer portion configured to receive the replaceable printing component. The printer portion is adapted to read the data field within the electrical storage device and selectively access data within the electrical storage device based on the specified data organization.

9 Claims, 5 Drawing Sheets

METHOD AND APPARATUS FOR CHECKING COMPATIBILITY OF A REPLACEABLE PRINTING COMPONENT

CROSS REFERENCE TO RELATED APPLICATION (S)

This is a continuation of copending application Ser. No. 09/146,746 filed on Sep. 3, 1998, which is hereby incorporated by reference herein.

BACKGROUND OF THE INVENTION

The present invention relates to ink-jet printing systems that make use of a replaceable printing component. More particularly, the present invention relates to replaceable printing components that include an electrical storage device for providing information to the ink-jet printing system.

Ink-jet printers frequently make use of an ink-jet printhead mounted within a carriage that is moved back and forth across a print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system to not move with the carriage. For the case where the ink supply is not carried with the carriage, the ink supply can be intermittently or continuously connected to the printhead for replenishing the printhead. In either case, the replaceable printing components, such as the ink container and the printhead, require periodic replacement. The ink supply is replaced when exhausted. The printhead is replaced at the end of printhead life.

It is frequently desirable to alter printer parameters concurrently with the replacement of printer components such as discussed in U.S. Pat. No. 5,699,091 entitled "Replaceable Part With Integral Memory For Usage, Calibration And Other Data" assigned to the assignee of the present invention. U.S. Pat. No. 5,66,091 discloses the use of a memory device, which contains parameters relating to the replaceable part. The installation of the replaceable part allows the printer to access the replaceable part parameters to ensure high print quality. By incorporating the memory device into the replaceable part and storing replaceable part parameters in the memory device within the replaceable component the printing system can determine these parameters upon installation into the printing system. This automatic updating of printer parameters frees the user from having to update printer parameters each time a replaceable component is newly installed. Automatically updating printer parameters with replaceable component parameters ensures high print quality. In addition, this automatic parameter updating tends to ensure the printer is not inadvertently damaged due to improper operation, such as, operating after the supply of ink is exhausted or operation with the wrong or non-compatible printer components.

It is important that the printing system have sufficient flexibility to accommodate improvements and additional printer parameters necessary to support these improvements. Replaceable printing components which incorporate improvements that are not compatible with the printing system or are for some other reason not compatible with the printing system should be identified by the printing system as non-compatible. The use of non-compatible printing components may damage the printing system or result in reduced print quality.

SUMMARY OF THE INVENTION

The present invention is an ink jet printing system configured for receiving a replaceable printing component. The ink jet printing system includes a replaceable printing component having an electrical storage device associated therewith. The electrical storage device has a data field therein specifying data organization within the electrical storage device. Also included is a printer portion configured to receive the replaceable printing component. The printer portion is adapted to read the data field within the electrical storage device and selectively access data within the electrical storage device based on the specified data organization.

Another aspect of the present invention is a method for verifying compatibility of an ink jet printing component. The ink jet printing component has an electrical storage device associated therewith. The electrical storage device is responsive to printing control signals for transferring information between the printing component and the ink jet printing system. The method includes reading selected data from an address location corresponding to each replaceable consumable associated with the ink jet printing system. The selected data stored in an electrical storage device is associated with each replaceable consumable. The method includes determining compatibility of each replaceable consumable based on the selected data.

Another aspect of the present invention is a method for specifying data organization in an electrical storage device. The electrical storage device is associated with a replaceable printing component of a printing system. The electrical storage device is responsive to printing control signals for transferring information between the printing component and the ink jet printing system. The method includes providing an electrical storage device. The method also includes storing a data element specifying a particular data organization from a plurality of data organizations. The specified data organization is indicative of data organization of data stored on the electrical storage device. The specified organization allows the ink jet printing system to properly identify data that is transferred between the electrical storage device and the ink jet printing system.

DETAILED DESCRIPTION OF THE PREFERRED EMBODIMENT

Figure 1:
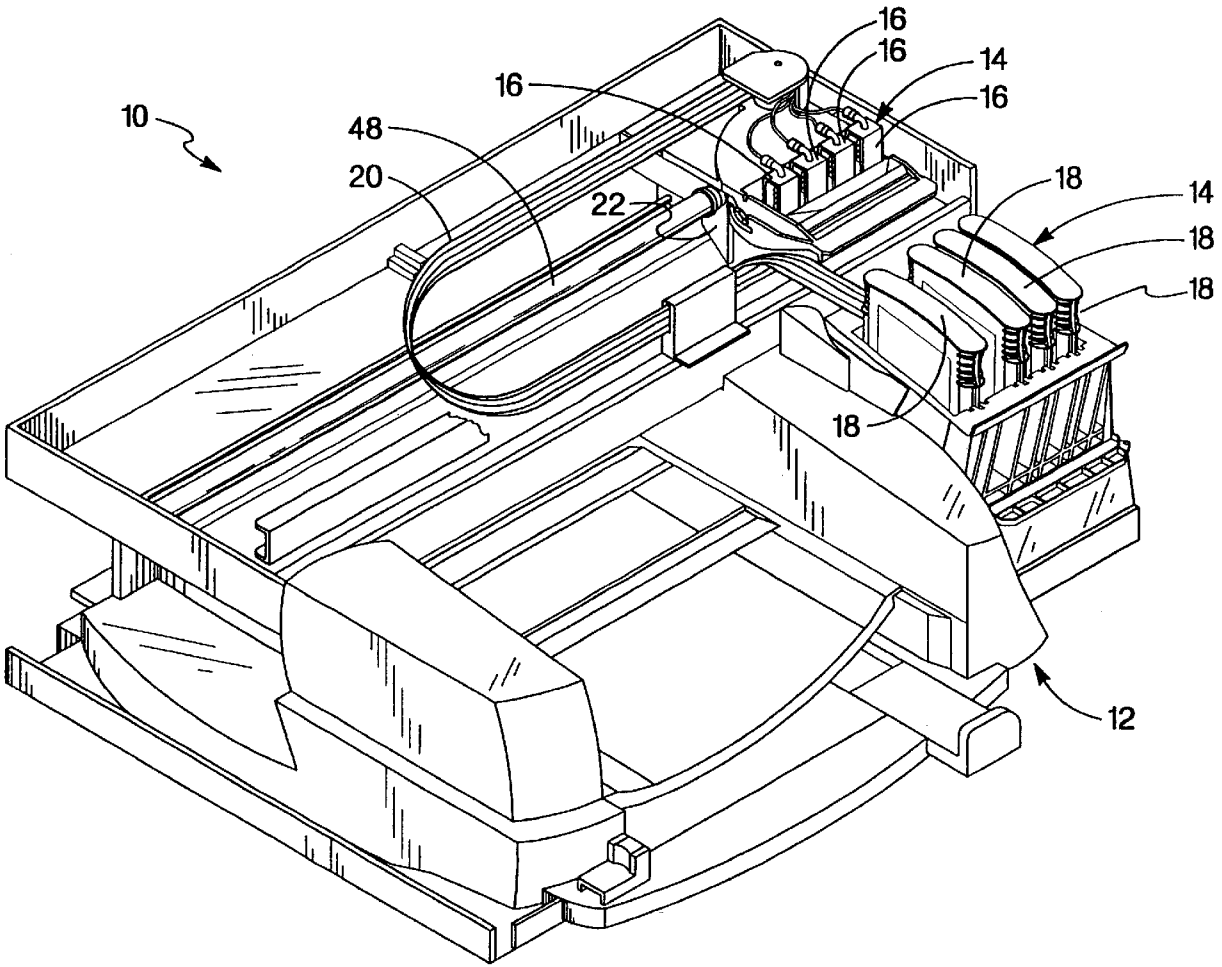
FIG. 1 depicts a perspective view of an exemplary ink-jet printing system, shown with the cover removed, that incorporates removable printing components of the present invention.

FIG. 1 is a perspective view of one exemplary embodiment of an ink-jet printing system 10 of the present invention shown with its cover removed. The ink-jet printing system 10 includes a printer portion 12 having a plurality of replaceable printing components 14 installed therein. The plurality of replaceable printing components 14 include a plurality of printheads 16 for selectively depositing ink in response to control signals and a plurality of ink containers 18 for providing ink to each of the plurality of printheads 16. Each of the plurality of printheads 16 is fluidically connected to each of the plurality of ink containers 18 by a plurality of flexible conduits 20.

Each of the plurality of printheads 16 is mounted in a scanning carriage 22, which is scanned past a print media (not shown) as the print media is stepped through a print zone. As the plurality of printheads are moved relative to the print media, ink is selectively ejected from a plurality of orifices in each of the plurality of the printheads 16 to form images and text.

One aspect of the present invention is a method and apparatus for storing information on the replaceable printing components 14 and reading this stored information to determine a method the printer portion 12 uses to read the remaining stored information. An electrical storage device is associated with each of the replaceable printing components 14. The electrical storage device contains information related to the particular replaceable printer component 14. Installation of the replaceable printing component 14 into the printer portion 12 allows information to be transferred between the electrical storage device and the printing portion 12 to ensure high print quality as well as to prevent the installation of non-compatible replaceable printing components 14. The information provided from the replaceable printing component 14 to the printing portion 12 tends to prevent operation of the printing system 10 in a manner which damages the printing system 10 or which reduces the print quality.

Although the printing system 10 shown in FIG. 1 makes use of ink containers 18 which are mounted off of the scanning carriage 22, the present invention is equally well suited for other types of printing system configurations. One such configuration is one where the replaceable ink containers 18 are mounted on the scanning carriage 22. Alternatively, the printhead 16 and the ink container 18 may be incorporated into an integrated printing cartridge that is mounted to the scanning carriage 22. Finally, the printing system 10 may be used in a wide variety of applications such as facsimile machines, postal franking machines, copiers and large format type printing systems suitable for use in displays and outdoor signage.

Figures 2A, 2B:
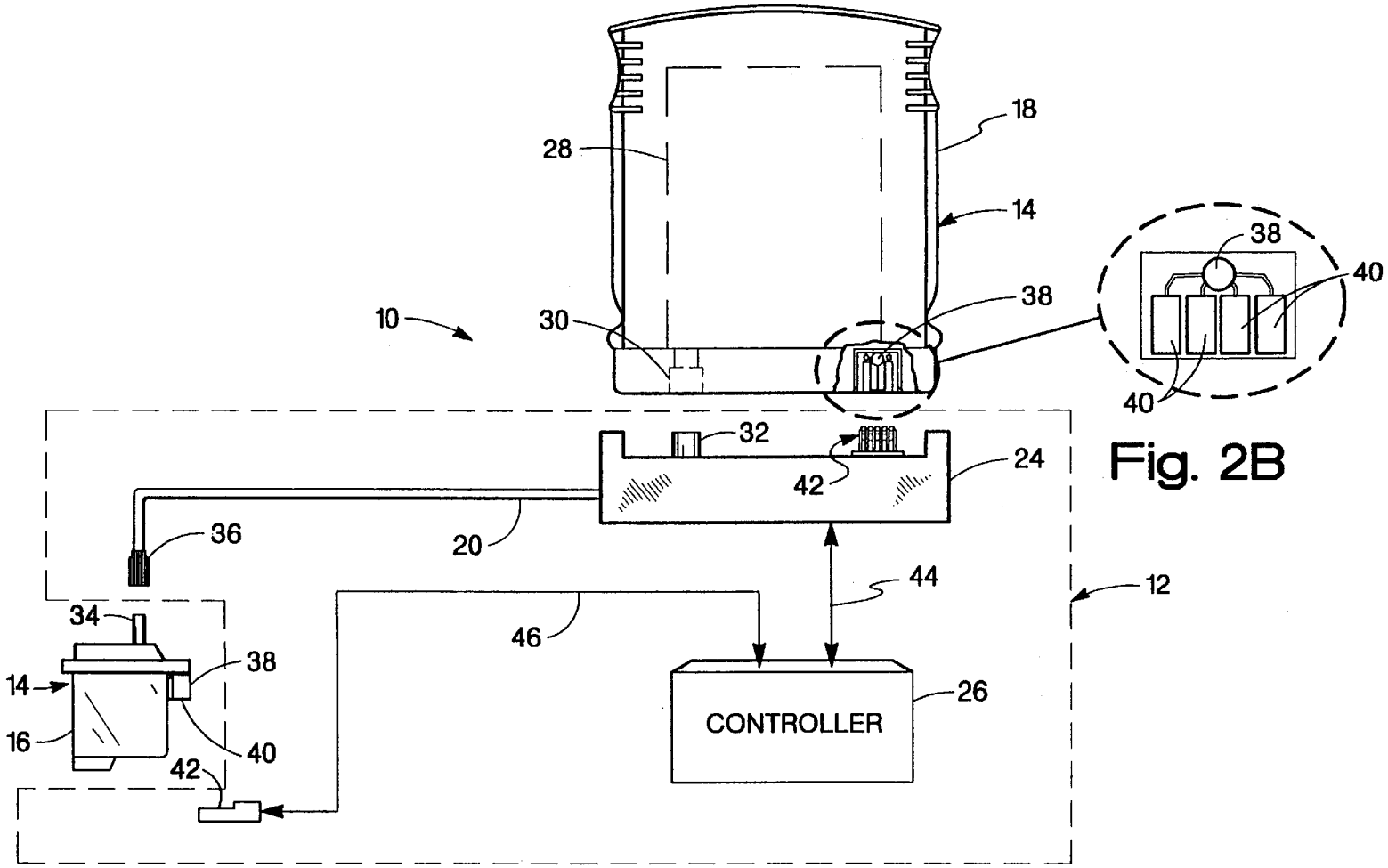
FIGS. 2A and 2B depict a schematic representation of the ink-jet printing system shown in FIG. 1 illustrating a removable ink container and printhead each of which contain an electrical storage device of the present invention.

FIGS. 2A and 2B depict a simplified schematic representation of the ink-jet printing system 10 of the present invention shown in FIG. 1. FIGS. 2A and 2B are simplified to illustrate a single printhead 16 and a single ink container 18 for accomplishing the printing of a single color. For the case where more than one color is desired a plurality of printheads 16 are typically used each having an associated ink container 18 as shown in FIG. 1.

The ink-jet printing system 10 of the present invention includes a printer portion 12 having replaceable printing components 14. The replaceable printing components 14 include a printhead 16 and an ink container 18. The printer portion 12 includes an ink container receiving station 24 and a controller 26. With the ink container 18 properly inserted into the ink container receiving station 24, an electrical and a fluidic coupling is established between the ink container 18 and the printer portion 12. The fluidic coupling allows ink stored within the ink container 18 to be provided to the printhead 16. The electrical coupling allows information to be passed between the ink container 18 and the printer portion 12 to ensure the operation of the printer portion 12 is compatible with the ink contained in the ink container 18 thereby achieving high print quality and reliable operation of the printing system 10.

The controller 26 controls the transfer of information between the printer portion 12 and the ink container 18. In addition, the controller 26 controls the transfer of information between the printhead 16 and the controller 26. Finally, the controller 26 controls the relative movement of the printhead 16 and the print media as well as selectively activating the printhead to deposit ink on print media.

The ink container 18 includes a reservoir 28 for storing ink therein. A fluid outlet 30 is provided that it is in fluid communication with the fluid reservoir 28. The fluid outlet 30 is configured for connection to a complimentary fluid inlet 32 associated with the ink container receiving station 24.

The printhead 16 includes a fluid inlet 34 configured for connection to a complimentary fluid outlet 36 associated with the printing portion 12. With the printhead 16 properly inserted into the scanning carriage 22 (shown in FIG. 1) fluid communication is established between the printhead and the ink container 18 by way of the flexible fluid conduit 20.

Each of the replaceable printing components 14 such as the printhead 16 and the ink container 18 include an electrical storage device 38 such as an electrical storage device or memory 38 for storing information related to the respective replaceable printer component 14. A plurality of electrical contacts 40 are provided, each of which is electrically connected to the electrical storage device 38. With the ink container 18 properly inserted into the ink container receiving station 24, each of the plurality of electrical contacts 40 engage a corresponding plurality of electrical contacts 42 associated with the ink container receiving station 24. Each of the plurality of electrical contacts 42 associated with the ink container receiving station 24 are electrically connected to the controller 26 by a plurality of electrical conductors 44. With proper insertion of the ink container 18 into the ink container receiving station 24, the electrical storage device 38 associated with the ink container 18 is electrically connected to the controller 26 allowing information to be transferred between the ink container 18 and the printer portion 12.

Similarly, the printhead 16 includes an electrical storage device 38 such as an electrical storage device associated therewith. A plurality of electrical contacts 40 are electrically connected to the electrical storage device 38 in a manner similar to the electrical storage device 38 associated with the ink container 18. With the printhead 16 properly inserted into the scanning carriage 22 the plurality of electrically contacts 40 engage a corresponding plurality of electrical contacts 42 associated with the printing device 12. Once properly inserted into the scanning carriage, the electrical storage device 38 associated with the printhead 16 is electrically connected to the controller 26 by way of a plurality of electrical conductors 46.

Although electrical storage devices 38 associated with each of the ink container 18 and the printhead 16 are given the same element number to indicate these devices are similar, the information stored in the electrical storage device 38 associated with the ink container 18 will, in general, be different from the information stored in the electrical storage device 38 associated with the printhead 16. Similarly, the information stored in electrical storage device 38 associated with each ink container of the plurality of ink containers 18 will in general be different and unique to the particular ink container of the plurality of ink containers 18. The particular information stored on each electrical storage device 38 will be discussed in more detail later.

Figure 3:
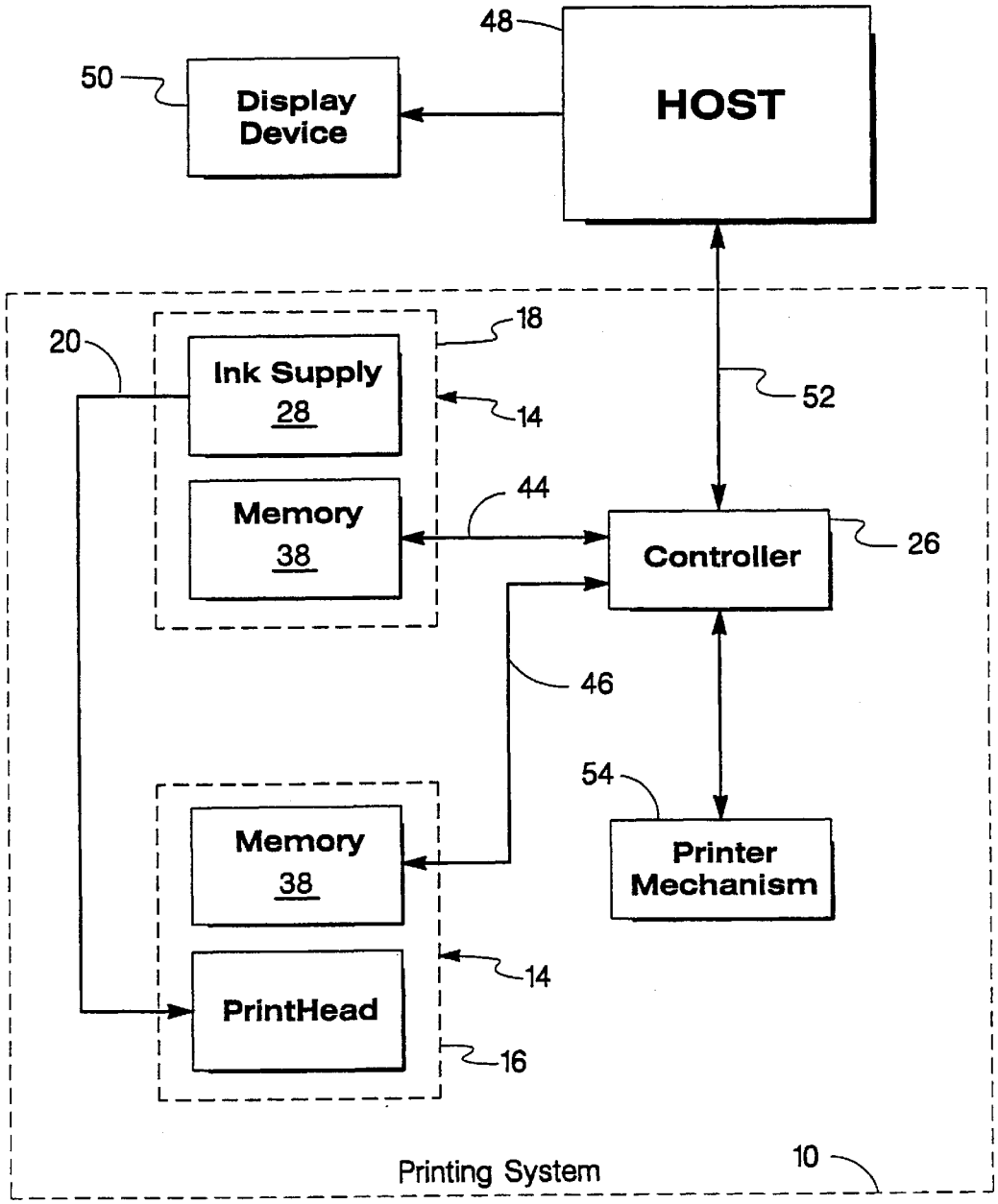
FIG. 3 depicts a schematic block diagram of the ink-jet printing system of FIG. 1 shown connected to a host and which includes a removable ink container and printhead each of which contain the electrical storage device of the present invention.

FIG. 3 represents a block diagram of the printing system 10 of the present invention shown connected to an information source or host computer 48. The host computer 48 is shown connected to a display device 50. The host 48 can be a variety of information sources such as a personal computer, work station, or server to name a few, that provides image information to the controller 26 by way of a data link 52. The data link 52 may be any one of a variety of conventional data links such as an electrical link or an infrared link for transferring information between the host 48 and the printing system 10.

The controller 26 is electrically linked to the electrical storage devices 38 associated with each of the printhead 16 and the ink container 18. In addition, the controller 26 is electrically linked to a printer mechanism 54 for controlling media transport and movement of the carriage 22. This link may be a variety of different linkages such as electrical or optical linkage that supports information. transfer. The controller 26 makes use of parameters and information provided by the host 48, the electrical storage device 38 associated with the ink container 18 and electrical storage device 38 associated with the printhead 16 to accomplish printing.

The host computer 48 provides image description information or image data to the printing system 10 for forming images on print media. In addition, the host computer 48 provides various parameters for controlling operation of the printing system 10, which is typically resident in printer control software typically referred to as the "print driver". In order to ensure the printing system 10 provides the highest quality images it is necessary that the operation of the controller 26 compensate for the particular replaceable printer component 14 installed within the printing system 10. It is the electric storage device 38 that is associated with each replaceable printer component 14 that provides parameters particular to the replaceable printer component 14 that allows the controller 26 to utilize these parameters to ensure the reliable operation of the printing system 10 and ensure high quality print images.

Among the parameters, for example which can be stored in electrical storage device 38 associated with the replaceable printing component 14 are the following: actual count of ink drops emitted from the printhead 16; a date code associated with the ink container 18; date code of initial insertion of the ink container 18; system coefficients; ink type/color: ink container size; age of the ink; printer model number or identification number; cartridge usage information; just to name a few.

Figure 4:
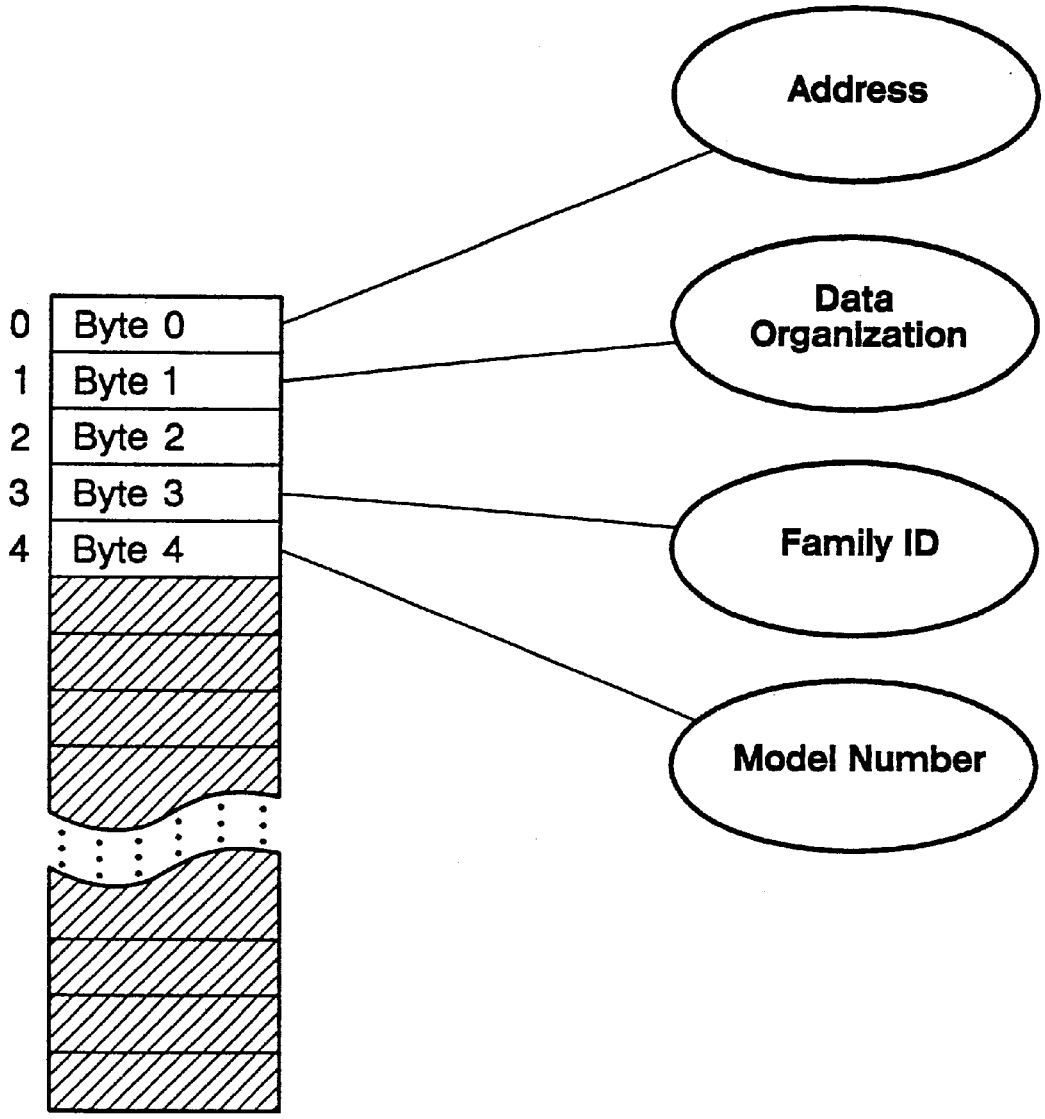
FIG. 4 depicts a representation of the electrical storage device of the present invention illustrating information contained within the electrical storage device.

FIG. 4 is a representation of the electrical storage device 38 that is used in conjunction with the controller 26 of the printing system 10 for ensuring compatibility and data integrity for data transfers between the electrical storage device 38 and the controller 26. The electrical storage device 38 is organized as an 8 bit by N memory where N represents the size of the memory device. Each individually addressable 8 bit memory location is represented by a range of address values from 0 to N−1. FIG. 4 illustrates only some of the information stored in the electrical storage device 38. The electrical storage device 38 contains a variety of additional information not discussed. The information stored in electrical storage device 38 includes address information, data organization information, family identification information, color code information, and model number information. The printer portion 12 utilizes portions of this information to ensure the replaceable printing component is compatible with the printer portion 12. The method by which the printer portion 12 verifies compatibility of each of the replaceable printing components will be discussed in more detail with respect to FIG. 5. In addition, the location of the information in the electrical storage device 38 may be different from those locations shown in FIG. 4. It is important that the controller 26 in the printing system 10 know where at least some of the information is stored.

Figure 5:
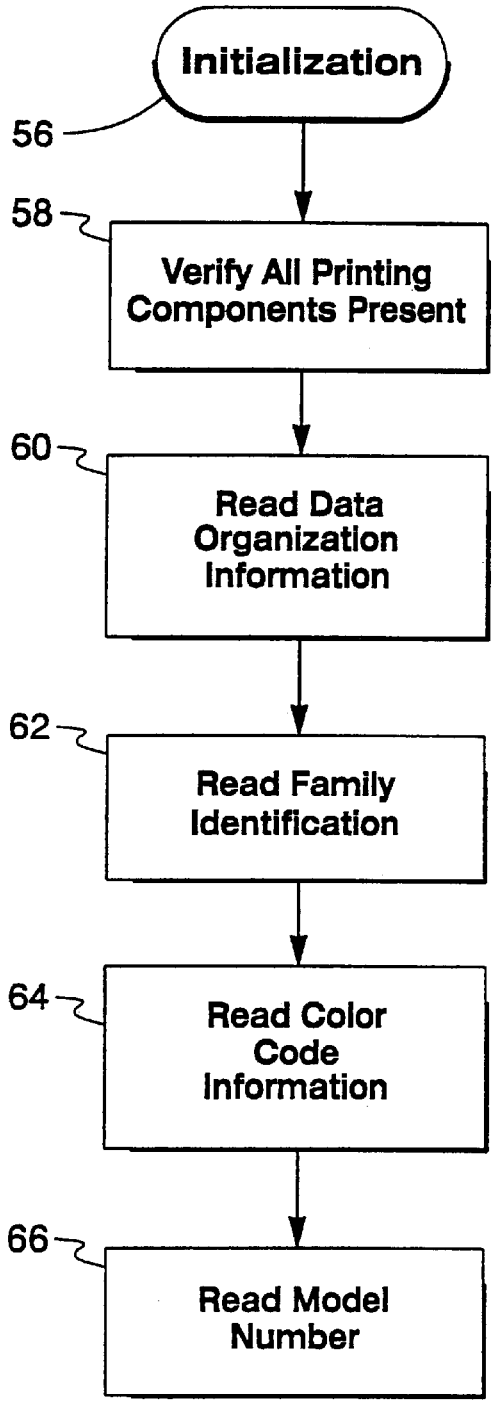
FIG. 5 depicts the method of the present invention for identifying compatible replaceable printing components.

FIG. 5 represents a method of the present invention for verifying compatibility of each of the replaceable printing components 14 in the printing system 10. The method of the present invention is performed upon initialization of the printing system 10 as represented by step 56. Initialization occurs is when the printing system 10 is powered up or when a new replaceable printing component 14 is installed into the printer portion 12. Initialization may occur at other times also such as upon a printer reset or in the event of a failure, to name a few.

The printer portion 12 next determines if all the replaceable printing components 14 are present in the ink jet printing system 10 as represented by step 58. In the preferred embodiment, once each of the replaceable printing components 14 are properly inserted into the printer portion 12 the electrical storage devices 38 associated with each of the replaceable printing components 14 are coupled by a serial link represented by conductors 44 and 46 to the controller 26. This serial link allows information to pass between the controller 26 and the information storage device in a serial fashion. This serial link may be established in a variety of ways such as a serial conductor bus, an optical link, or some other suitable technique for exchanging information in a serial fashion. It is preferred that the controller and electrical storage device 38 be linked in a serial fashion to minimize the number of conductors required thereby reducing the cost as well as improving the manufacturability of the printing system 10.

The controller 26 attempts to read information from each of the replaceable printing components 14 of the printing system 10. Each of the replaceable printing components has a unique address such that the controller 26 can selectively read information from each individual replaceable printing component to verify that it is properly positioned within the printer portion 12. In one preferred embodiment, a three-bit address is associated with each of the replaceable printing components as shown in Table 1. Table 1 represents an ink jet printing system 10 that is a four color printing system that includes an individual printhead 16 associated with each of the four colors cyan, magenta, yellow, and black and four ink containers each associated with one of the printheads. In the case where the printing system 10 makes use of more than four colors such as high fidelity printing, the number of bits required to uniquely address each of the replaceable printing components 14 will be greater than three bits.

TABLE 1

| Address | Replaceable Printing Component |
|---|---|
| 000 | black printhead |
| 001 | cyan printhead |
| 010 | magenta printhead |
| 011 | yellow printhead |
| 100 | black ink container |
| 101 | cyan ink container |

TABLE 1-continued

| Address | Replaceable Printing Component |
|---|---|
| 110 | magenta ink container |
| 111 | yellow ink container |

In the preferred embodiment, each of the replaceable printing components 14 is connected to a common serial bus. Therefore, the printer portion 10 verifies the presence of a replaceable printing component 14 corresponding to each of the required replaceable printing components in the system 10. However, the use of a serial bus does not provide verification that each of these printing components 14 are installed in the proper location within the printer portion 12. Therefore, mechanical keying is used to ensure each of the replaceable printing components 14 is installed in the proper location.

To ensure reliability of the ink jet printing system 10 the mechanical keying system ensures that the replaceable printing component 14 has a compatible color associated herewith. The mechanical keying system also ensures that the replaceable printing component 14 is of a compatible type such as compatible ink chemistry. Insertion of a magenta ink container into a magenta slot on the printer portion 12 can result in damage to the printer portion 12 if this magenta ink container contains ink that is incompatible with magenta ink within the printer portion 12. Therefore, to ensure maximum reliability of the printing system 10, mechanical keying is used to exclude both non-compatible ink color types as well as non-compatible ink chemistries. The mechanical keying technique is described in more detail in patent application entitled, "Keying System For Ink Supply Containers", Ser. No. 08/566,521 filed on Dec. 4, 1995 and assigned to the assignee of the present invention and incorporated herein by reference.

In the event that all of the printing components required are not present in the printing system 10, the printing system 10 is prevented from printing. An attempt to print without all of the required replaceable printing components 14 would result in reduced print quality.

Next, the printing system controller 26 associated with the printer portion 12 determines if the data organization is compatible for the electrical storage device 38 associated with the replaceable printing component 14 as represented by step 60. The data organization information is a three-bit value specifying how data is organized in the electrical storage device 38. For example, the data organization information can specify that the data is stored in a fixed format or a flexible format. A fixed format identifies that data resides in specified locations throughout the electrical storage device 38. In contrast, a flexible data format identifies that data resides in locations that are specified by the electrical storage device 38. In this case, the printer portion 12 reads tag information to determine what data is in the electrical storage device 38 as well as its particular location of the data in the electrical storage device 38. The flexible format will be discussed in more detail with respect to the discussion of the family identification.

Both the fixed format and the flexible format of data storage offer varying tradeoffs that vary from printer to printer. For example, the use of a fixed format reduces the size of the electrical storage device 38 for a given amount of data to be stored. The fixed format does not require the use of tags for identifying data values and data locations within the electrical storage device 38 thereby reducing overhead. The overhead requires a larger storage area for a given amount of data to be stored. The use of a flexible data format requires more memory overhead thereby reducing the useful memory size of the electrical storage but provides greater flexibility. For example, the flexible data format allows additional parameters to be added to support newer printers or printer upgrades while allowing the replaceable printing component to be downwardly compatible. In the event that the printer portion 12 does not recognize a proper data organization code, the printer portion 12 halts printing.

The controller 26 next reads the family identification as represented by step 62. The family identification (ID) allows data to be accessed in a flexible format as discussed previously. A family ID is provided with each electrical storage device 38 as shown in FIG. 4. The family ID is shown in address value 2, labeled byte 2, for illustrative purposes. The family ID in general will be in a memory location that is known to the printer control electronics 26. In the preferred embodiment the family ID is a 5-bit value that identifies the particular family of replaceable printing component 14. The printing system 10 uses this family ID to interpret a tag ID that is associated with data stored in the electrical storage device 38. This may be implemented by using a plurality of different Decodes with each Decode unique to a particular family ID. The printing system 10 selects the proper Decode based on family ID and then uses this Decode to decode or interpret each tag ID associated with that family.

In operation, the printing system 10 reads the family ID from the electrical storage device 38. The printing system then selects the proper Decode from a plurality of different Decodes based on the family ID. The printer portion 12 then reads the electrical storage device 38 until it recognizes a tag ID value. This tag ID is decoded based on the Decode selected. The Decoded tag ID identifies the data that follows the tag. This data is then read by the printing system 10. The printing system 10 then jumps to the next tag ID and reads this tag ID. This process continues until all of the tags and associated parameters have been read into the printing system.

In the case where the printing system 10 includes a plurality of replaceable printing components 14 as shown in FIG. 1, if each replaceable printing component parameter value required a unique tag ID, the tag ID field size would be very large if a separate family Decode for each family type was not used. This large tag ID would consume significantly more memory as well as require greater overhead in the transactions with the printing device. Therefore, there is a significant saving by providing a family ID and then interpreting the tag IDs based on this family ID.

Next, the controller 26 reads color code information as represented by step 64. The color code information is a data value that specifies the exact color associated with the replaceable printing component 14. This color code, for example, specifies color revision, dye-loads, etc. Therefore, the mechanical keying ensures the replaceable printing component 14 associated with magenta is installed into the proper magenta location. The color code information specifies further detail of this magenta color such as the revision number of the magenta dye, the particular dye-load of the magenta ink, etc. In the preferred embodiment, the color code information is an eight-byte value for specifying the specifics of the particular color associated with the replaceable printing component 14. If the proper color code information is not present the printer portion 12 will not print to ensure print quality is not comprised.

Next, the controller 26 reads the model number associated with the replaceable printing component 14 as represented by step 66. The model number specifies the particular types of replaceable printing components 14 based upon its characteristics other than color. An acceptable model number indicates that the replaceable printing component 14 is compatible with the printing system 10. A compatible replaceable printing component 14 indicates that the print quality and reliability will not be compromised by the particular component short or long term.

In an illustrative example, a model number can be used to differentiate a first ink container 18 having a first model number and adapted to be pressurized from a second ink container having a second model number and adapted to be unpressurized. Pressurization is typically done for higher performance printing systems 10 that require higher ink flow rates. In this illustrative example, the Family ID and the Data Organization are the same and furthermore, initial installation of ink container 18 into printing system 10 will not cause immediate damage, such as precipitation of ink in fluid inlet 32. However, printing with the wrong version of the ink container 18 will cause immediate or long term print quality or performance problems. Thus, the system verifies an acceptable model number before printing. If a printing system 10 is designed with a high degree of flexibility, then it may accept multiple model numbers of compatible replaceable printing components 14 to reflect this flexibility.

As another illustrative example, the model number can be used to differentiate two replaceable components 14 (printheads or ink containers) having a different but compatible ink chemistry. In this example, the two different replaceable components 14 would each have the same family ID's and color codes, but would have a different model number to reflect the ink chemistry difference. Using the component with the wrong model number would not cause immediate damage to printing system 10. However, the wrong model number might result in a long term reliability or a short term print quality problem. In any of these examples, mechanical keys may also be used to distinguish the components with different model numbers, but the limited number of mechanical arrangements possible may not make this possible. Thus, the model number can be used as a form of electronic keying to prevent problems other than those that result in immediate damage to the printer portion 12.

Although the present invention has been described with respect to the preferred embodiment where the replaceable printing components 14 are the printhead portion 16 mounted on the print carriage 22 and the ink container 18 mounted in the receiving station 24 the present invention is suited for other printer configurations as well. For example, the printhead portion and the ink container portion may each be mounted on the printing carriage 22. For this configuration each of the printhead portion and the ink container portion are separately replaceable. Each of the printhead portion and the ink container includes an electrical storage device 38 for providing information to the printing portion 12. Each of the ink containers of a plurality of ink containers may be separately replaceable or replaceable as an integrated unit. For the case where the plurality of ink containers is integrated into a single replaceable printing component 14 then only a single electrical storage device 38 may be required for this single replaceable printing component 14.

What is claimed is:

1. A replaceable marking component for a marking system, the marking system having at least one replaceable marking component, the replaceable marking component comprising:

an information storage device responsive to marking system control signals for transferring information between the replaceable marking component and the marking system, the information storage device having a plurality of data organizations for storing data therein; and data stored within the information storage device for specifying a particular data organization from a plurality of data organizations so that information can be selectively transferred between the information storage device and the marking system, wherein the data specifying the particular data organization is a three-bit value representing that the data format is a fixed data format.

2. The replaceable marking component of claim 1 further including data stored within the information storage device for specifying a particular marking media associated with the replaceable marking component.

3. The replaceable marking component of claim 1, wherein the information storage device is a serial device for communicating with the marking system in a serial fashion.

4. A replaceable marking component for a marking system, the marking system having at least one replaceable marking component, the replaceable marking component comprising:

an information storage device responsive to marking system control signals for transferring information between the replaceable marking component and the marking system, the information storage device having a plurality of data organizations for storing data therein; and data stored within the information storage device for specifying a particular data organization from a plurality of data organizations so that information can be selectively transferred between the information storage device and the marking system, wherein the data specifying the particular data organization is a three-bit value representing that the data format is a variable data format.

5. The replaceable marking component of claim 4 further including a tag family identifier for selecting a family of tags from a plurality of families of tags.

6. The replaceable marking component of claim 4 further including data stored within the information storage device for specifying a particular address value from a plurality of address values with each address value unique to each replaceable marking component within the marking system.

7. A method for specifying data organization in an electrical storage device, the electrical storage device associated with a replaceable marking component of a marking system, the electrical storage device responsive to marking control signals for transferring information between the marking component and the marking system, the method comprising:

providing an electrical storage device; storing a data element indicative of a variable data format in the electrical storage device, the data element specifying a particular data organization from a plurality of data organizations, the particular data organization indicative of data organization of data stored on the electrical storage device, the data element specifying the particular data organization being readable by the marking system thereby allowing the marking system to properly identify data transferred between the electrical storage device and the marking system based upon the particular data organization; and storing in the electrical storage device a tag family identifier for selecting a family of tags from a plurality of families of tags.

8. The method of claim 7, further comprising storing a particular address value in the electrical storage device from a plurality of address values with each address value unique to the particular replaceable marking component.

9. A method for verifying compatibility of a marking component, the marking component having an electrical storage device associated therewith, the electrical storage device responsive to control signals for transferring information between the marking system component and a marking system, the method comprising:

reading selected data from an address location of an electrical storage device corresponding to each replaceable consumable associated with the marking system, wherein the selected data is stored in the electrical storage device associated with each replaceable consumable, and wherein the selected data is organization information for specifying a particular data organization from a plurality of data organizations within the corresponding electrical storage device; and determining compatibility of each replaceable consumable based on the selected data;

wherein the selected data is a family identifier for selecting a family of tags from a plurality of families of tags.

* * * * *